US007213644B1

(12) United States Patent
Zupanick

(10) Patent No.: US 7,213,644 B1
(45) **Date of Patent: *May 8, 2007**

(54) CAVITY POSITIONING TOOL AND METHOD

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/687,362

(22) Filed: Oct. 14, 2003

Related U.S. Application Data

(60) Division of application No. 10/188,159, filed on Jul. 1, 2002, now abandoned, which is a continuation of application No. 09/632,273, filed on Aug. 3, 2000, now Pat. No. 6,412,556.

(51) Int. Cl.
*E21B 47/00* (2006.01)

(52) U.S. Cl. ..... 166/255.2; 166/241.3; 166/104; 405/55

(58) Field of Classification Search ..... 166/241.1, 166/241.3, 241.7, 222, 241.2, 241.4, 241.5; 366/312, 325.2, 308, 249, 254, 343, 66, 195; 417/430; 175/263, 319; 403/53, 55; 261/92; 416/140, 44
See application file for complete search history.

(56) References Cited

U.S. PATENT DOCUMENTS

| | | | | |
|---|---|---|---|---|
| 54,144 A | | 4/1866 | Hamar | |
| 130,442 A | | 8/1872 | Russell | 166/243 |
| 274,740 A | | 3/1883 | Douglass | |
| 526,708 A | | 10/1894 | Horton | |
| 639,036 A | | 12/1899 | Heald | |
| 1,189,560 A | | 7/1916 | Gondos | |
| 1,230,666 A | | 6/1917 | Carden | |
| 1,285,347 A | | 11/1918 | Otto | |
| 1,317,192 A | | 9/1919 | Jones | |
| 1,467,480 A | * | 9/1923 | Hogue | 175/263 |
| 1,485,615 A | | 3/1924 | Jones | |
| 1,498,463 A | | 6/1924 | McCloskey et al. | |
| 1,589,508 A | | 6/1926 | Boynton | |
| 1,674,392 A | | 6/1928 | Flansburg | |
| 1,710,998 A | | 4/1929 | Rudkin | |
| 1,777,961 A | | 10/1930 | Capeliuschnicoff | |

(Continued)

FOREIGN PATENT DOCUMENTS

CA 1067819 12/1979

(Continued)

OTHER PUBLICATIONS

Joseph A. Zupanick; Declaration of Experimental Use with attached exhibits A-D, pp. 1-3, Nov. 14, 2000.

(Continued)

*Primary Examiner*—David Bagnell
*Assistant Examiner*—Daniel P Stephenson
(74) *Attorney, Agent, or Firm*—Fish & Richardson P.C.

(57) ABSTRACT

In accordance with the teachings of the present invention, a method is provided for preventing formation of sludge in a subsurface cavity having particulate laden fluid disposed therein. The method includes positioning a downhole device having a fluid agitator into the fluid of the subsurface cavity and agitating the fluid using the fluid agitator.

19 Claims, 5 Drawing Sheets

U.S. PATENT DOCUMENTS

| | | | | | |
|---|---|---|---|---|---|
| 1,970,063 | A | | 8/1934 | Steinman | |
| 2,018,285 | A | | 10/1935 | Schweitzer et al. | 166/21 |
| 2,031,353 | A | | 2/1936 | Woodruff | |
| 2,033,521 | A | | 3/1936 | Horn | 166/237 |
| 2,069,482 | A | | 2/1937 | Seay | 255/76 |
| 2,150,228 | A | | 3/1939 | Lamb | 166/10 |
| 2,169,502 | A | | 8/1939 | Santiago | |
| 2,169,718 | A | | 8/1939 | Böll et al. | 255/24 |
| 2,203,998 | A | | 6/1940 | O'Grady | |
| 2,250,912 | A | | 7/1941 | Hudson et al. | |
| 2,290,502 | A | | 7/1942 | Squires | 255/76 |
| 2,335,085 | A | | 11/1943 | Roberts | 251/107 |
| 2,450,223 | A | | 9/1948 | Barbour | 255/76 |
| 2,490,350 | A | | 12/1949 | Grable | 166/4 |
| 2,662,486 | A | * | 12/1953 | Hillger | 166/105 |
| 2,679,903 | A | | 6/1954 | McGowen, Jr., et al. | 166/1 |
| 2,726,063 | A | | 12/1955 | Ragland et al. | 255/1.8 |
| 2,783,018 | A | | 2/1957 | Lytle | 251/25 |
| 2,814,463 | A | | 11/1957 | Kammerer, Jr. | |
| 2,847,189 | A | | 8/1958 | Shook | 255/76 |
| 2,911,008 | A | | 11/1959 | Du Bois | 137/625.31 |
| 2,980,142 | A | | 4/1961 | Turak | 137/637.3 |
| 3,087,552 | A | | 4/1963 | Graham | |
| 3,107,731 | A | | 10/1963 | Dinning | 166/217 |
| 3,126,065 | A | | 3/1964 | Chadderdon | |
| 3,196,961 | A | | 7/1965 | Kammerer | |
| 3,236,320 | A | | 2/1966 | Russ | 175/263 |
| 3,339,647 | A | | 9/1967 | Kammerer, Jr. | 175/268 |
| 3,347,595 | A | | 10/1967 | Dahms et al. | 299/4 |
| 3,378,069 | A | * | 4/1968 | Fields | 166/113 |
| 3,379,266 | A | | 4/1968 | Fletcher | |
| 3,397,750 | A | | 8/1968 | Wicklund | |
| 3,443,648 | A | | 5/1969 | Howard | 175/103 |
| 3,473,571 | A | | 10/1969 | Dugay | 137/625.4 |
| 3,503,377 | A | | 3/1970 | Beatenbough et al. | 123/117 |
| 3,528,516 | A | | 9/1970 | Brown | 175/267 |
| 3,530,675 | A | | 9/1970 | Turzillo | 61/35 |
| 3,552,509 | A | | 1/1971 | Brown | |
| 3,554,304 | A | | 1/1971 | Link et al. | |
| 3,598,193 | A | | 8/1971 | Hilton | |
| 3,656,564 | A | | 4/1972 | Brown | |
| 3,684,041 | A | | 8/1972 | Kammerer, Jr., et al. | 175/267 |
| 3,692,041 | A | | 9/1972 | Bondi | 137/238 |
| 3,731,753 | A | | 5/1973 | Weber | |
| 3,757,876 | A | | 9/1973 | Pereau | 175/267 |
| 3,757,877 | A | | 9/1973 | Leathers | 175/269 |
| 3,800,830 | A | | 4/1974 | Etter | 137/625.41 |
| 3,809,519 | A | | 5/1974 | Garner | 425/245 |
| 3,828,867 | A | | 8/1974 | Elwood | 175/45 |
| 3,874,413 | A | | 4/1975 | Valdez | 137/625.47 |
| 3,902,322 | A | | 9/1975 | Watanabe | 61/35 |
| 3,934,649 | A | | 1/1976 | Pasini, III et al. | 166/254 |
| 3,957,082 | A | | 5/1976 | Fuson et al. | 137/625.41 |
| 3,961,824 | A | | 6/1976 | Van Eek et al. | 299/17 |
| 4,037,658 | A | | 7/1977 | Anderson | 166/272 |
| 4,073,351 | A | | 2/1978 | Baum | 175/14 |
| 4,083,653 | A | * | 4/1978 | Stiffler | 416/142 |
| 4,089,374 | A | | 5/1978 | Terry | 166/259 |
| 4,116,012 | A | | 9/1978 | Abe et al. | 405/238 |
| 4,151,880 | A | | 5/1979 | Vann | 166/314 |
| 4,156,437 | A | | 5/1979 | Chivens et al. | 137/554 |
| 4,158,388 | A | | 6/1979 | Owen et al. | 166/286 |
| 4,169,510 | A | | 10/1979 | Meigs | 175/65 |
| 4,189,184 | A | | 2/1980 | Green | 299/8 |
| 4,220,203 | A | | 9/1980 | Steeman | 166/271 |
| 4,221,433 | A | | 9/1980 | Jacoby | 299/4 |
| 4,243,099 | A | | 1/1981 | Rodgers, Jr. | 166/65 R |
| 4,245,699 | A | | 1/1981 | Steeman | |
| 4,257,650 | A | | 3/1981 | Allen | 299/2 |
| 4,278,137 | A | | 7/1981 | Van Eek, deceased | 175/267 |
| 4,296,785 | A | | 10/1981 | Vitello et al. | 141/105 |
| 4,299,295 | A | | 11/1981 | Gossard | 175/45 |
| 4,312,377 | A | | 1/1982 | Knecht | 137/625.19 |
| 4,317,492 | A | | 3/1982 | Summers et al. | 175/79 |
| 4,323,129 | A | | 4/1982 | Cordes | |
| 4,366,988 | A | | 1/1983 | Bodine | 299/14 |
| 4,372,398 | A | | 2/1983 | Kuckes | 175/45 |
| 4,390,067 | A | | 6/1983 | Willman | 166/245 |
| 4,396,076 | A | | 8/1983 | Inoue | 175/265 |
| 4,397,360 | A | | 8/1983 | Schmidt | 175/61 |
| 4,398,769 | A | | 8/1983 | Jacoby | |
| 4,401,171 | A | | 8/1983 | Fuchs | 175/267 |
| 4,407,376 | A | | 10/1983 | Inoue | 175/267 |
| 4,442,896 | A | | 4/1984 | Reale et al. | 166/278 |
| 4,494,616 | A | | 1/1985 | McKee | 175/67 |
| 4,512,422 | A | | 4/1985 | Knisley | 175/99 |
| 4,527,639 | A | | 7/1985 | Dickinson, III et al. | 175/61 |
| 4,532,986 | A | | 8/1985 | Mims et al. | 166/50 |
| 4,544,037 | A | | 10/1985 | Terry | 166/369 |
| 4,549,630 | A | | 10/1985 | Brown | 181/106 |
| 4,558,744 | A | | 12/1985 | Gibb | 166/335 |
| 4,565,252 | A | | 1/1986 | Campbell et al. | 175/269 |
| 4,600,061 | A | | 7/1986 | Richards | 175/62 |
| 4,605,076 | A | | 8/1986 | Goodhart | 175/61 |
| 4,611,855 | A | | 9/1986 | Richards | 299/2 |
| 4,618,009 | A | | 10/1986 | Carter et al. | 175/267 |
| 4,638,949 | A | | 1/1987 | Mancel | 239/307 |
| 4,674,579 | A | | 6/1987 | Geller et al. | 175/45 |
| 4,702,314 | A | | 10/1987 | Huang et al. | 166/245 |
| 4,715,440 | A | | 12/1987 | Boxell et al. | 166/100 |
| 4,763,734 | A | | 8/1988 | Dickinson et al. | 175/62 |
| 4,830,105 | A | | 5/1989 | Petermann | 166/241 |
| 4,842,081 | A | | 6/1989 | Parant | 175/23 |
| 4,852,666 | A | | 8/1989 | Brunet et al. | 175/61 |
| 4,887,668 | A | | 12/1989 | Lynde et al. | 166/55.8 |
| 4,978,172 | A | | 12/1990 | Schwoebel et al. | 299/12 |
| 4,981,367 | A | | 1/1991 | Brazelton | 366/308 |
| 5,009,273 | A | | 4/1991 | Grabinski | |
| 5,016,710 | A | | 5/1991 | Renard et al. | 166/245 |
| 5,035,605 | A | | 7/1991 | Dinerman et al. | 425/564 |
| 5,036,921 | A | | 8/1991 | Pittard et al. | 166/298 |
| 5,074,360 | A | | 12/1991 | Guinn | 166/281 |
| 5,074,365 | A | | 12/1991 | Kuckes | 175/40 |
| 5,074,366 | A | | 12/1991 | Karlsson et al. | 175/76 |
| 5,111,893 | A | | 5/1992 | Kvello-Aune | 175/258 |
| 5,135,058 | A | | 8/1992 | Millgard et al. | 175/71 |
| 5,148,875 | A | | 9/1992 | Karlsson et al. | 175/62 |
| 5,168,942 | A | | 12/1992 | Wydrinski | 175/50 |
| 5,174,374 | A | | 12/1992 | Hailey | 166/55.8 |
| 5,197,553 | A | | 3/1993 | Leturno | 175/57 |
| 5,197,783 | A | | 3/1993 | Theimer et al. | 299/17 |
| 5,199,496 | A | | 4/1993 | Redus et al. | 166/366 |
| 5,201,817 | A | | 4/1993 | Hailey | 175/269 |
| 5,217,076 | A | | 6/1993 | Masek | 166/303 |
| 5,240,350 | A | | 8/1993 | Yamaguchi et al. | 405/143 |
| 5,242,017 | A | | 9/1993 | Hailey | 166/55.8 |
| 5,246,273 | A | | 9/1993 | Rosar | 299/4 |
| 5,255,741 | A | | 10/1993 | Alexander | 166/278 |
| 5,271,472 | A | | 12/1993 | Leturno | 175/107 |
| 5,301,760 | A | | 4/1994 | Graham | 175/61 |
| 5,348,091 | A | | 9/1994 | Tchakarov et al. | 166/217 |
| 5,363,927 | A | | 11/1994 | Frank | 175/67 |
| 5,385,205 | A | | 1/1995 | Hailey | 166/55.8 |
| 5,392,862 | A | | 2/1995 | Swearingen | |
| 5,402,851 | A | | 4/1995 | Baiton | 166/369 |
| 5,402,856 | A | | 4/1995 | Warren et al. | 175/57 |
| 5,411,085 | A | | 5/1995 | Moore et al. | 166/242 |
| 5,411,104 | A | | 5/1995 | Stanley | 175/65 |
| 5,413,183 | A | | 5/1995 | England | 175/53 |
| 5,450,902 | A | | 9/1995 | Matthews | 166/268 |
| 5,454,419 | A | | 10/1995 | Vloedman | 166/277 |
| 5,462,116 | A | | 10/1995 | Carroll | 166/249 |
| 5,469,155 | A | | 11/1995 | Archambeault et al. | 340/853.4 |
| 5,485,089 | A | | 1/1996 | Kuckes | 324/346 |

| | | | | |
|---|---|---|---|---|
| 5,494,121 | A | 2/1996 | Nackerud | 175/263 |
| 5,499,687 | A | 3/1996 | Lee | |
| 5,501,273 | A | 3/1996 | Puri | 166/252.5 |
| 5,501,279 | A | 3/1996 | Garg et al. | 166/372 |
| 5,584,605 | A | 12/1996 | Beard et al. | 405/128 |
| 5,613,425 | A | 3/1997 | Krznaric | 99/348 |
| 5,615,739 | A | 4/1997 | Dallas | 166/306 |
| 5,659,347 | A | 8/1997 | Taylor | 347/85 |
| 5,669,444 | A | 9/1997 | Riese et al. | 166/263 |
| 5,690,390 | A | 11/1997 | Bithell | 299/4 |
| 5,706,871 | A | 1/1998 | Andersson et al. | 141/59 |
| 5,720,356 | A | 2/1998 | Gardes | 175/62 |
| 5,722,489 | A | 3/1998 | Lambe et al. | 166/269 |
| 5,785,133 | A | 7/1998 | Murray et al. | 175/61 |
| 5,832,958 | A | 11/1998 | Cheng | 137/625.41 |
| 5,853,054 | A | 12/1998 | McGarian et al. | 175/267 |
| 5,868,202 | A | 2/1999 | Hsu | 166/256 |
| 5,868,210 | A | 2/1999 | Johnson et al. | 175/40 |
| 5,879,057 | A | 3/1999 | Schwoebel et al. | 299/17 |
| 5,917,325 | A | 6/1999 | Smith | 324/326 |
| 5,934,390 | A | 8/1999 | Uthe | 175/67 |
| 5,957,539 | A | 9/1999 | Durup et al. | 299/4 |
| 6,024,171 | A | 2/2000 | Montgomery et al. | 166/308 |
| 6,070,677 | A | 6/2000 | Johnston, Jr. | |
| 6,082,461 | A | 7/2000 | Newman et al. | 166/381 |
| 6,142,232 | A * | 11/2000 | Troutt et al. | 166/312 |
| 6,217,260 | B1 | 4/2001 | He | 405/237 |
| 6,227,312 | B1 | 5/2001 | Eppink et al. | 175/57 |
| 6,302,666 | B1 | 10/2001 | Grupping | |
| 6,378,626 | B1 | 4/2002 | Wallace | 175/19 |
| 6,412,556 | B1 | 7/2002 | Zupanick | 166/255.2 |
| 6,454,000 | B1 | 9/2002 | Zupanick | 166/243 |
| 6,454,024 | B1 | 9/2002 | Nackerud | |
| 6,494,272 | B1 | 12/2002 | Eppink et al. | 175/57 |
| 6,533,035 | B2 * | 3/2003 | Troutt et al. | 166/249 |
| 6,575,255 | B1 | 6/2003 | Rial et al. | |
| 6,591,922 | B1 | 7/2003 | Rial et al. | |
| 6,595,301 | B1 | 7/2003 | Diamond et al. | |
| 6,595,302 | B1 | 7/2003 | Diamond et al. | |
| 6,644,422 | B1 | 11/2003 | Rial et al. | 175/57 |
| 6,681,855 | B2 | 1/2004 | Zupanick et al. | |
| 6,722,452 | B1 | 4/2004 | Rial et al. | |
| 6,761,219 | B2 | 7/2004 | Snider et al. | |
| 6,923,275 | B2 | 8/2005 | Gardes | |
| 7,090,034 | B2 | 8/2006 | Rives | |
| 2002/0070052 | A1 | 6/2002 | Armell et al. | 175/273 |
| 2004/0011560 | A1 | 1/2004 | Rial et al. | |
| 2004/0084183 | A1 | 5/2004 | Zupanick | |
| 2004/0206547 | A1 | 10/2004 | de Luca | |
| 2004/0222022 | A1 | 11/2004 | Nevlud et al. | |
| 2005/0092525 | A1 | 5/2005 | Teale et al. | |

FOREIGN PATENT DOCUMENTS

| | | | | |
|---|---|---|---|---|
| DE | 1 207 907 | | 12/1965 | |
| DE | 197 25 996 | A1 | 1/1998 | |
| EP | 0300627 | A1 | 1/1989 | |
| EP | 0 819 834 | A1 | 1/1998 | 43/28 |
| EP | 0 875 661 | A1 | 11/1998 | |
| EP | 0 952 300 | A1 | 10/1999 | |
| WO | 94 21889 | | 9/1994 | 43/24 |
| WO | WO 01/83932 | A1 | 11/2001 | |

OTHER PUBLICATIONS

Howard L. Hartman, et al.; "*SME Mining Engineering Handbook*;" Society for Mining, Metallurgy, and Exploration, Inc, pp. 1946-1950, 2nd Edition, vol. 2, 1992.

Pending Patent Application, Joseph A Zupanick, *Cavity Well Positioning System and Method*, filed Oct. 24, 2000.

Pending Patent Application, Joseph A. Zupanick, "*Method and System for Accessing Subterranean Deposits From The Surface*," Serial No. 09/789,956, filed Feb. 20, 2001.

Pending Patent Application, Joseph A. Zupanick, "*Method and System for Accessing Subterranean Deposits From The Surface*," Serial No. 09/788,897, filed Feb. 20, 2001.

Pending Patent Application, Joseph A. Zupanick, "*Method and System for Accessing Subterranean Deposits From The Surface*," Serial No. 09/791,033, filed Feb. 20, 2001.

Pending Patent Application, Joseph A. Zupanick, *Method and System for Enhanced Access to a Subterrean Zone*, Serial No. 09/769,098, filed Jan. 24, 2001.

Pending Patent Application, Joseph A. Zupanick, *Method and System for Accessing a Subterrean Zone from a Limited Surface Area*, Serial No. 09/774,996, filed Jan. 30, 2001.

Pending Patent Application, Joseph A. Zupanick, *Method and System for Accessing a Subterrean Zone from a Limited Surface Area*, Serial No. 09/773,217, filed Jan. 30, 2001.

Nackerud Product Description, Sep. 27, 2001.

ABI Oil Tools, E-Tronics, "Tubing Rotator Operating Effectiveness," Models and Specifications, Published prior to Jun. 2000.

Notification of Transmittal of the International Search Report or the Declaration (PCT Rule 44.1) mailed Jul. 4, 2003 (10 pages) re International Application No. PCT/US 03/04771.

Zupanick et al, U.S. Patent Application entitled, "Cavity Positioning Tool and Method," U.S. Appl. No. 10/188,159, Jul. 1, 2002 (28 pages).

Notification of Transmittal of the International Search Report or the Declaration (PCT Rule 44.1) (3 pages) and International Search Report (5 pages) re International Application No. PCT/US 03/14828 mailed Sep. 2, 2003 (International Pub. #WO 03/102355 A1).

Zupanick et al., U.S. Patent Application entitled, "Slot Cavity," U.S. Appl. No. 10/419,529, Apr. 21, 2003 (43 pages).

Notification of Transmittal of the International Search Report or the Declaration (PCT Rule 44.1) mailed Nov. 13, 2003 (8 pages) re International Application No. PCT/US 03/21891, Jul. 15, 2003.

Zupanick, U.S. Patent Application entitled "Enlarging Well Bores Having Tubes Therein," U.S. Appl. No. 11/019,694, Dec. 21, 2004 (41 pages).

Invitation to pay Additional Fees (3 pages) and Annex to Form PCT/ISA/206 Communication Relating to the Results of the Partial International Search (2 pages) for International Application No. PCT/US2005/046431 mailed May 2, 2006.

Notification of Transmittal of International Preliminary Examination Report (1 page) and International Preliminary Examination Report (3 pages) for International Application No. PCT/US03/14828 mailed Nov. 1, 2004.

Notification of Transmittal of the International Search Report and the Written Opinion of the International Searching Authority, or the Declaration (1 page), Notes to Form PCT/ISA/200 (2 pages), International Search Report (7 pages), and Written Opinion of the International Searching Authority (8 pages) for International Application No. PCT/US2005/046431 mailed Aug. 14, 2006.

* cited by examiner

CAVITY POSITIONING TOOL AND METHOD

CROSS-REFERENCE TO RELATED APPLICATION

This application is a divisional of U.S. application Ser. No. 10/188,159, filed Jul. 1, 2002 now abandoned, by Joseph A. Zupanick, entitled "Cavity Positioning Tool and Method" which is a continuation of U.S. patent application Ser. No. 09/632,273 filed Aug. 3, 2000 by Joseph A. Zupanick, entitled "Cavity Positioning Tool and Method", now U.S. Pat. No. 6,412,556.

TECHNICAL FIELD OF INVENTION

This invention relates generally to the field of downhole cavity tools and more particularly to a cavity positioning tool and method.

BACKGROUND OF THE INVENTION

Subsurface resources such as oil, gas, and water are typically recovered by drilling a bore hole from the surface to a subterranean reservoir or zone that contains the resources. The bore hole allows oil, gas, and water to flow to the surface under its own pressure. For low pressure or depleted zones, rod pumps are often used to lift the fluids to the surface.

To facilitate drilling and production operations, cavities are often formed in the production zone. The cavity allows the well bore to be more readily intersected during drilling operations and collects fluids during production operations. The collection of fluids allows pumps to be operated intermittently when the cavity is full, which reduces wear on the pump.

Short extensions called a "rat hole" are often formed at the bottom of the cavity to collect cuttings and other drilling debris. As the subsurface liquids collect in the well bore, the heavier debris falls to the bottom of the rat hole and is thereby both centralized and collected out of the cavity. To avoid being clogged with debris, inlets for rod and other downhole pumps should be positioned within the cavity above the rat hole. In addition, the pump inlet should be positioned fairly low in the cavity to avoid vapor lock (i.e., below the fluid waterline). Traditional methods of positioning the pump inlets, however, are often inaccurate and inefficient, leading to clogging or vapor lock and increased maintenance and operation costs for the well.

SUMMARY OF THE INVENTION

In accordance with the teachings of the present invention, a method is provided for preventing formation of sludge in a subsurface cavity having particulate laden fluid disposed therein. The method includes positioning a downhole device having a fluid agitator into the fluid of the subsurface cavity and agitating the fluid using the fluid agitator.

In accordance with one embodiment of the present invention, a method is provided for preventing formation of sludge in a subsurface cavity. The method includes positioning an inlet of a pump via a well bore into a cavity formed underground, the cavity including fluid and a plurality of particles in the fluid. The method further includes agitating the fluid and removing the fluid.

In accordance with another aspect of the present invention, a method is provided for removing particulate laden fluid from a subterranean zone. The method includes lowering an inlet of a pump through a well bore into a cavity formed in a subterranean zone, the cavity extending radially from the well bore. The method also includes radially extending within the cavity a plurality of arms coupled to the pump inlet and positioning the inlet in the cavity by resting the arms on a floor of the cavity. The method further includes collecting particulate laden fluid in the cavity, rotating the arms about a longitudinal axis of the pump, and removing the particulate laden fluid with the pump.

Important technical advantages of the invention include providing an improved cavity positioning tool and method. In particular, the tool includes arms that are retractable for lowering through a well bore to a cavity and extendable in the cavity to position a device within or at a set relation to the cavity. In one embodiment, the arms are extended by centrifugal force and automatically retract in the absence of centrifugal force. As a result, the tool has a minimum of parts and is highly durable.

Another technical advantage of the present invention includes providing a method and system for positioning a pump inlet in a cavity. In particular, the pump inlet is positioned in a lower portion of the cavity by extending arms that rest on the cavity floor above a rat hole. This position of the pump inlet significantly reduces clogging of the pump inlets and prevents the pump from inadvertently entering the rat hole. Additionally, this position minimizes vapor lock.

Still another technical advantage of the present invention includes providing an improved method for supporting a pump string extended from the surface to a subterranean zone. In particular, a pump string is supported from the floor of the cavity. This allows well head maintenance and other surface operations to be performed without pulling out or otherwise supporting the string from the surface.

Still another technical advantage of the present invention includes providing an improved method for removing solid-laden fluids from a coal seam or other subterranean zone. In particular, a pump inlet is coupled to a cavity positioning device with extending arms that rest on a cavity floor above a rat hole. The arms are rotated slowly to agitate the liquid in the cavity, thereby suspending debris to allow removal within the liquid and lowering the tendency of particulate matter to coalesce. Thus, the debris and particulate matter is less likely to form clumps of larger particles, which reduces clogging of the pump inlets.

Other advantages are readily apparent to one skilled in the art from the following figures, descriptions, and claims.

BRIEF DESCRIPTION OF THE DRAWINGS

For a more complete understanding of the present invention and its advantages, reference is now made to the following description, taken in conjunction with the accompanying drawings, in which.

DETAILED DESCRIPTION OF THE INVENTION

Figure 1A:
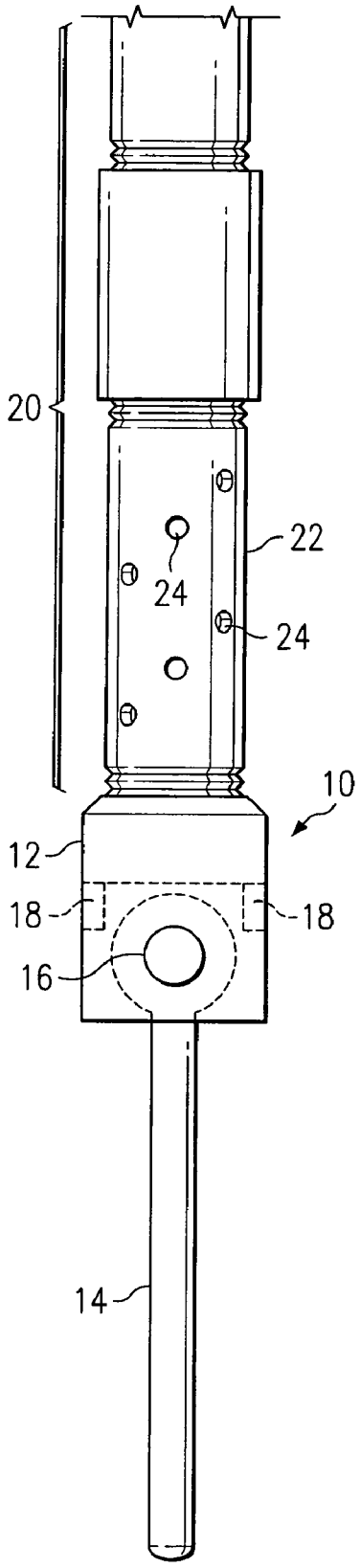
FIGS. 1A–B are diagrams illustrating side views of a cavity positioning tool in accordance with one embodiment of the present invention.
Figure 1B:
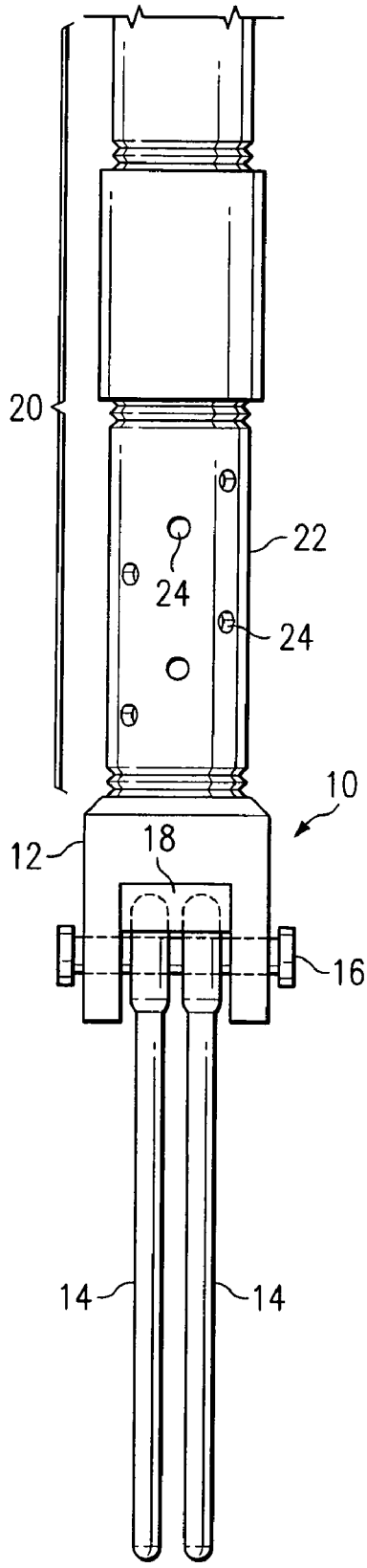

FIGS. 1A–B illustrate a cavity positioning tool 10 in accordance with one embodiment of the present invention. In this embodiment, tool 10 is adapted to position a pump inlet in a subsurface cavity. It will be understood that tool 10 may be adapted to position other suitable devices within or in relation to a cavity. For example, motors, controllers, and valves may be positioned in or relative to a cavity with the tool 10. Tool 10 is constructed of steel or other suitable metals or materials, such that are resistant to damage in the downhole environment.

Referring to FIG. 1A, the tool 10 comprises a head piece 12 and a plurality of blunt arms 14. As described in more detail below, the arms are coupled to the head piece 12 and operable to be radially extended outward from a first position of substantial alignment with a longitudinal axis associated with the head piece 12 to a second extended position. In the illustrated embodiment, the blunt arms 14 are coupled to head piece 12 by pivot assembly 16. It will be understood that blunt arms 14 may by slidably or otherwise suitably coupled to head piece 12.

The head piece 12 is configured at one end to receive a downhole string 20. Head piece 12 may be threaded to receive a downhole string, or may include clamps, interlocking pieces, or be otherwise suitably configured to attach to, engage, or mate with downhole string 20. Head piece 12 may be an integrated piece or a combination of components. For example, head piece 12 may include a downhole motor for rotating the head piece 12, such as a bottom part of the head piece 12, relative to the downhole string.

The downhole string 20 is a drill string, pump string, pipe, wireline, or other suitable downhole device that can be used to dispose the tool 10 within a cavity and extend the blunt arms 14. In the illustrated embodiment, the downhole string 20 is a pump string 22 with an inlet 24 coupled directly to the tool 10. The pump string 22 may be a sucker or other rod or multistage pump, a downhole pump with piping to the surface, or other suitable pumping system.

The blunt arms 14 are rounded, dull, or otherwise shaped so as to prevent substantial cutting of or damage to the cavity. In the illustrated embodiment, blunt arms 14 are cylindrical in shape with an elongated body and having a circular cross-section.

The blunt arms 14 may be end-weighted by adding weight to the ends distal to the head piece 12, or may comprise a hollow portion proximate to the head pin such that the ends of the blunt arms 14 are thereby made heavier than the rest of the blunt arms 14. The blunt arms 14 are sized to fit within a cavity when in an extended position and to exceed a diameter of a rat hole, bore hole, or other extensions, if any, below the cavity.

The pivot assembly 16 rotatably connects the blunt arms 14 to the head piece 12. In one embodiment, the pivot assembly 16 allows the blunt arms 14 to radially extend and retract in response to rotational energy applied to the tool 10. In this embodiment, pivot assembly 16 may be a clovis-and-pin type assembly.

As illustrated, blunt arms 14 hang freely down, in substantial alignment with the longitudinal axis of head piece 12. Blunt arms 14 are in substantial alignment when the blunt arms 14 hang freely down, within a few degrees of the longitudinal axis and/or fit down and through a well bore. As described in more detail below, in response to rotation of head piece 12, blunt arms 14 are radially extended towards a perpendicular position relative to head piece 12. The blunt arms 14 are automatically retracted when head piece 12 ceases to rotate by force of gravity or other suitable mechanism. It will be understood that the blunt arms 14 may be slidably or otherwise suitably connected to the head piece 12.

The pivot assembly 16 may include stops 18 to control extension of blunt arms 14. Stops 18 may be configured to allow blunt arms 14 to extend ninety degrees to a perpendicular position, may limit the extension of blunt arms 14 to a lesser range, or permit a range greater than ninety degrees. Stops 18 may be integral or adjustable. Controlling the stops 18, and the extension of blunt arms 14 thereby, controls the resting place of the pump string 22 relative to the floor of the cavity.

Figure 2A:
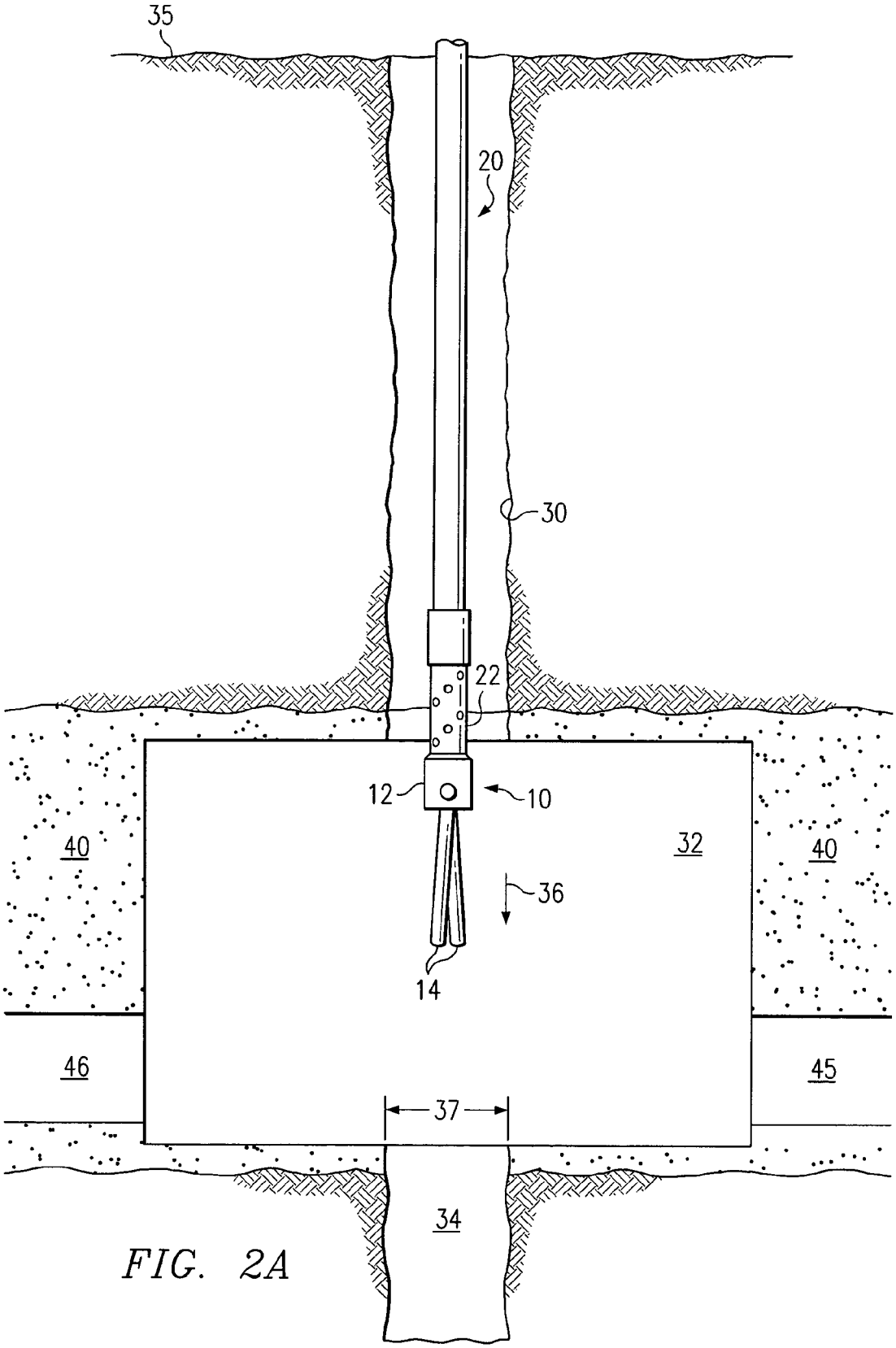
FIGS. 2A–C are a series of diagrams illustrating operation of the tool of FIG. 1 in accordance with one embodiment of the present invention; and, FIGS. 3A–B are a series of diagrams illustrating operation of the tool of FIG. 1, in accordance with another embodiment of the present invention.
Figure 2B:
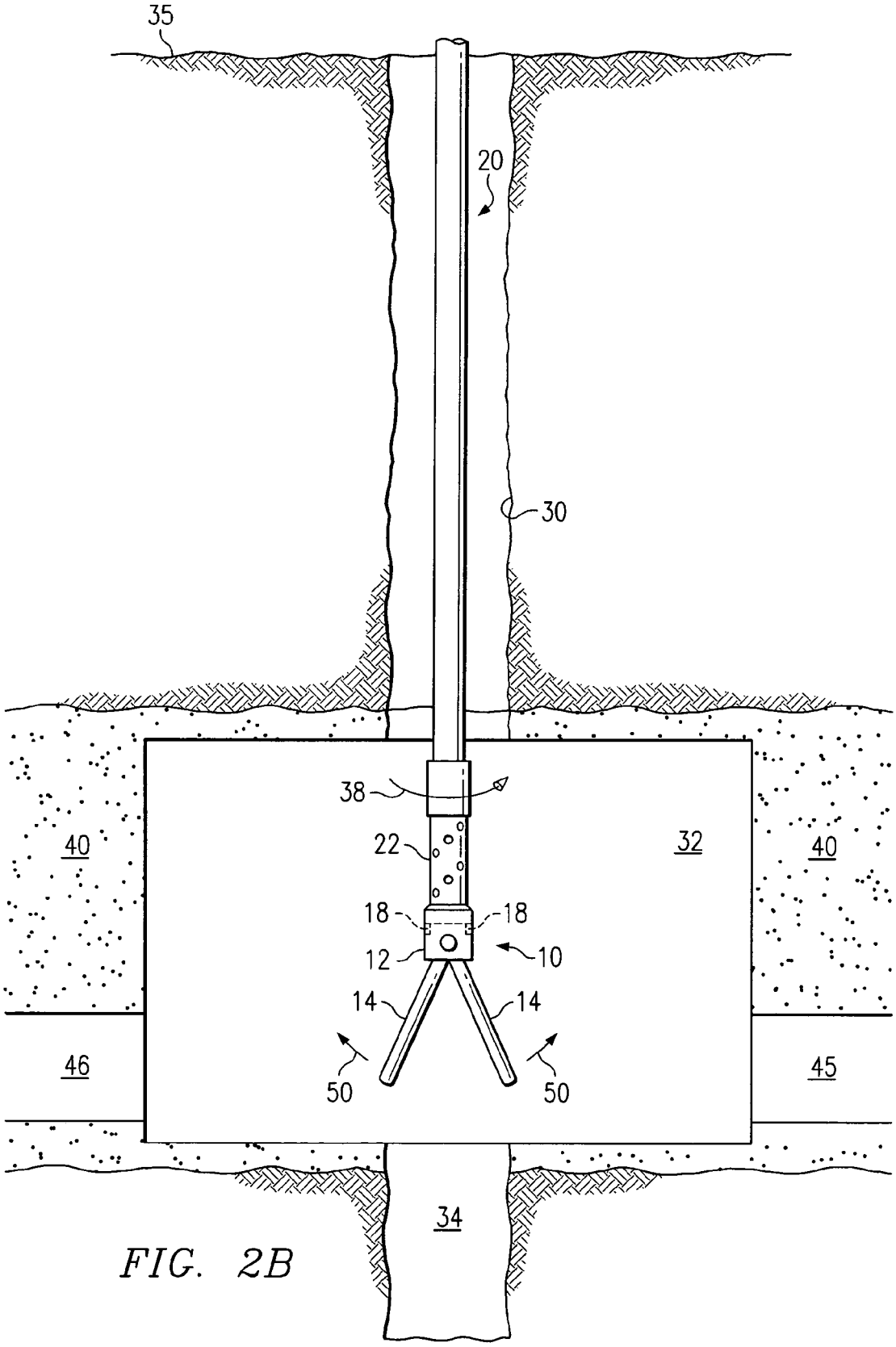
Figure 2C:
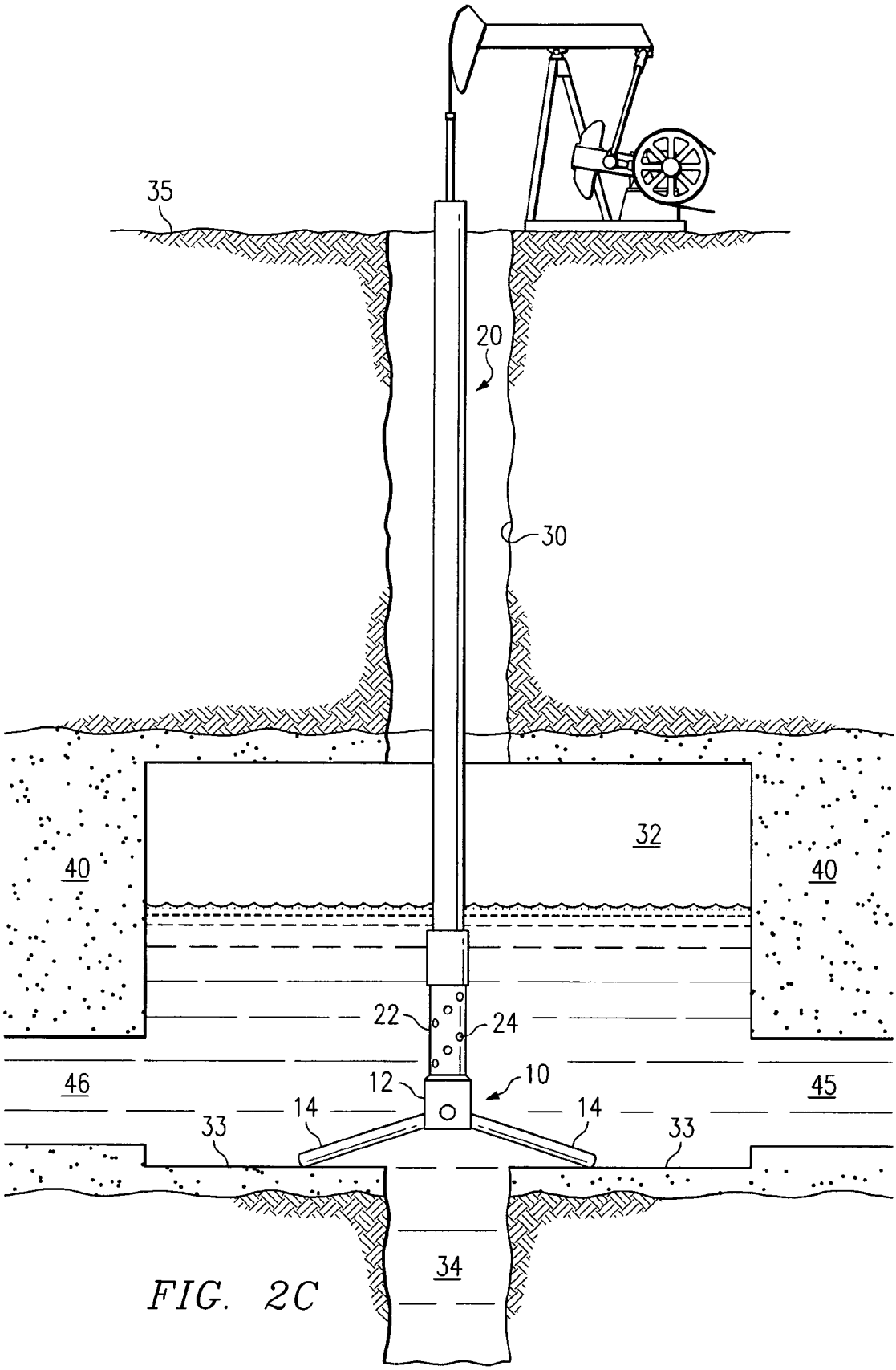

FIGS. 2A–C are a series of drawings illustrating the operation of tool 10. Referring to FIG. 2A, a pump string is positioned in a cavity for a degasification operation in connection with a coal seam prior to mining operations. In this embodiment, a well bore 30 is drilled from the surface 35 into a coal seam 40. A cavity 32 is formed within the coal seam 40. A rat hole 34 is drilled at the bottom of cavity 32. The rat hole 34 has a diameter 37. In a preferred embodiment, the blunt arms 14 have a length such that when extended, the distance from the distal end of one blunt arm 14 to the distal end of another blunt arm 14 exceeds the diameter 37. It will be noted that in this instance, as well as throughout this description, use of the word "each" includes all of any particular subset. A drainage pattern 45 is drilled from a radiused bore 46 and extends into the coal seam 40 and connects to cavity 32. The well bore 30 may have a diameter between seven and ten inches, the cavity a diameter between seven and nine feet, and the rat hole a diameter between seven and ten inches. Further information regarding the dual wells and drainage pattern is described in co-owned U.S. patent application Ser. No. 09/444,029, entitled "Method and System for Accessing Subterranean Deposits from the Surface," which is hereby incorporated by reference.

The pump string 20 is positioned by coupling an inlet to the coupling means 12 of the positioning tool 10. Next, the tool 10 on the pump string 20 is lowered through the well bore 30. While tool 10 is lowered through well bore 30, the blunt arms 14 remain in the retracted position with the blunt arms 14 hanging down in substantial alignment with the longitudinal axis of pump string 20. Blunt arms 14 are lowered until proximate to the cavity 32. Estimating the position of the cavity may be accomplished by comparing the known approximate depth of the cavity 32 to the length of pump string 20 in hand or deployed, or other suitable methods.

Referring to FIG. 2B, after the tool is positioned proximate to the cavity 32, blunt arms 14 are extended by rotating the head piece 12. In the illustrated embodiment, head piece 12, is rotated by rotating the pump string 20, for example, in the direction of arrow 38. As pump string 20 is rotated, the blunt arms 14 are extended radially outward from pump string 20 in opposite directions, traveling generally as indicated by arrow 50. One skilled in the art will recognize that other methods are available to extend blunt arms 14 radially outward from pump string 20. For example, mechanical means such as a wire connected to blunt arms 14 might be used to extend blunt arms 14 radially outward from pump string 20. The blunt arms 14 are extended until they contact the stops 18.

Referring to FIG. 2C, once the blunt arms 14 are extended, or while being extended, the pump string 20 is lowered further into well bore 30. Pump string 20 is lowered until blunt arms 14 make contact with the floor 33 of cavity 32. When resting on the cavity floor 33, pump inlets 24 are at a known position within the cavity 32. By adjusting the spacing between the pump inlets 24 and the blunt arms 14 of the tool 10, the distance between the pump inlets 24 and the cavity floor 33 can be modified. This adjustment may be made in a variety of ways, including adding spacers to the head piece 12. Additionally, by changing the maximum angle of the blunt arms 14, the distance between the pump inlets 24 and the cavity floor 33 can be modified. Adjusting the maximum angle of the blunt arms 14 can be accomplished in a variety of ways, including adjusting the stops 18 to restrict the radial extension of the blunt arms 14. Therefore, the present invention provides for more definite location of the pump inlets 24 within cavity 32, by use of positioning tool 10.

Once the pump 22 is positioned within cavity 32 by tool 10, fluids that drain from the drainage pattern 45 into the cavity 32 are pumped to the surface with the pump string 20. Fluids may be continuously or intermittently pumped as needed to remove the fluids from the cavity 32. Additionally, gas is diffused from the coal seam 40 and is continuously connected at the surface 35 as it passes through well bore 30.

When fluid and gas removal operations are complete, the tool 10 may be removed from its position within cavity 32. In reverse operation, pump string 20 is raised until blunt arms 14 are no longer in contact with the floor 33 of cavity 32. Blunt arms 14 are moved from an extended position to one of substantial alignment with pump string 20. If the blunt arms 14 were extended by centrifugal force, the blunt arms 14 will return to the first position of substantial alignment with pump string 20 upon being raised from the cavity floor. Once the blunt arms 14 have been returned to a position of substantial alignment with pump string 20, pump string 20 may be raised through and out of well bore 30.

Figure 3A:
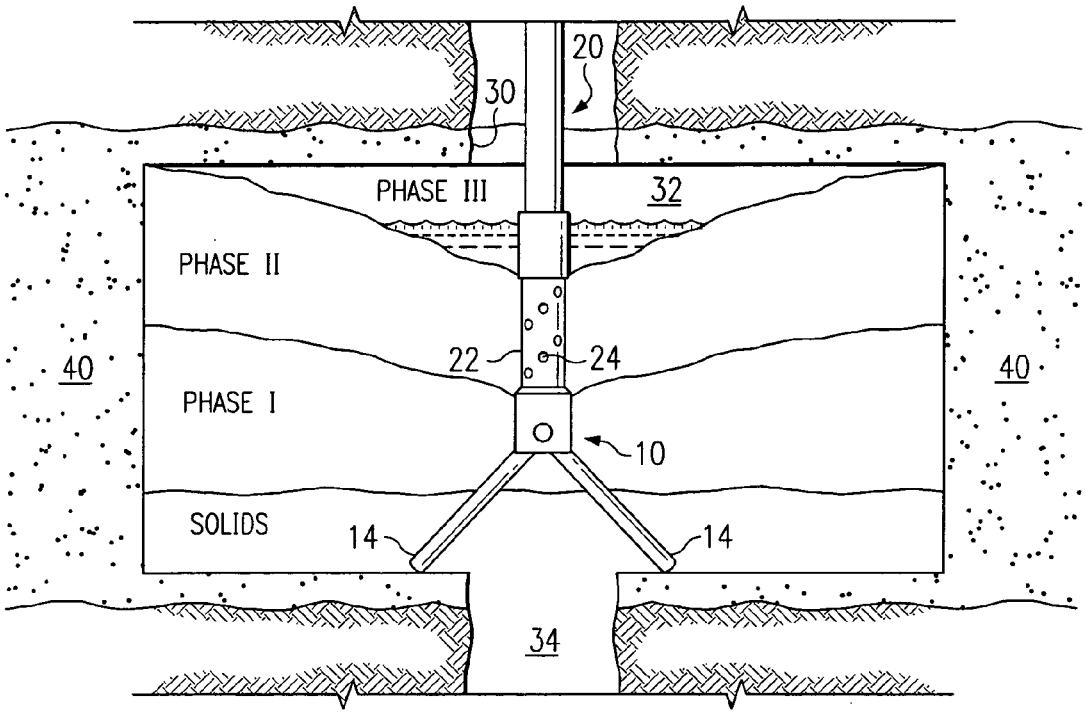
Figure 3B:
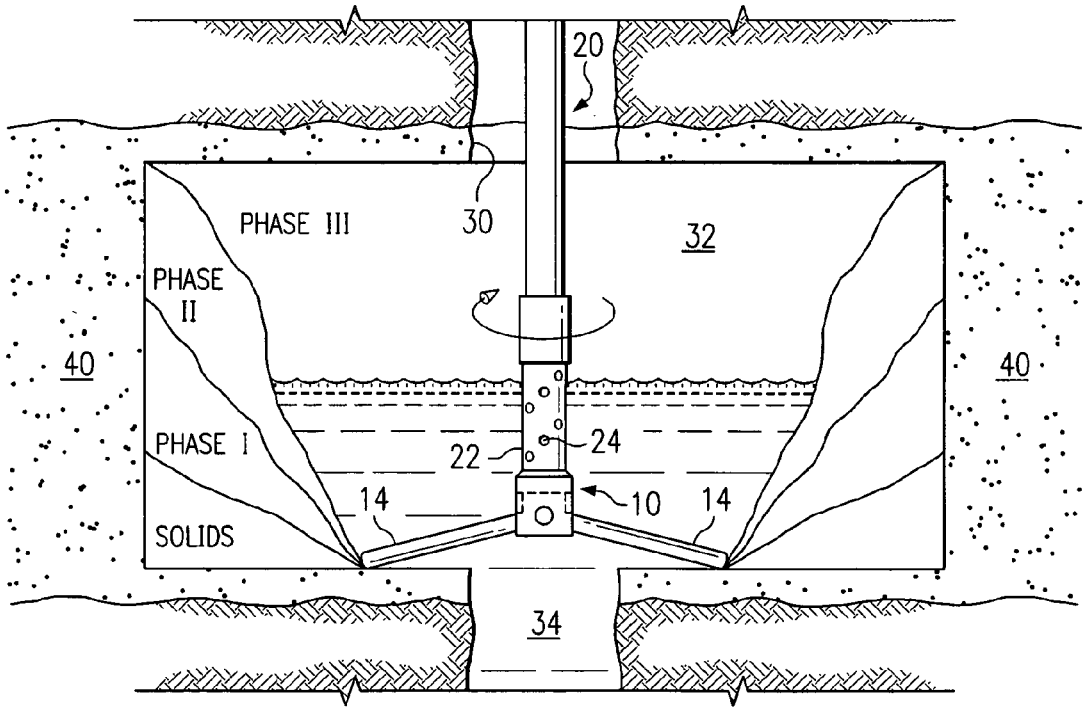

FIGS. 3A–B are a series of drawings illustrating operation of tool 10 during production of fluid and gas from the cavity 32. Referring to FIG. 3A, the pump string 20 is positioned in the cavity 32 for degasification operation of the coal seam 40 as previously described. The pump inlets 24 are positioned within the cavity 32 such that the pump inlets 24 are above rat hole 34, but below the waterline of the fluids collected in cavity 32.

As fluids are collected in the cavity 32, particulate matter and other debris such as drilling cuttings and coal fines are also collected in the cavity 32. Operation of the downhole pump 22 causes the suspended particulate matter and other debris to move through different locations within the body of fluid in cavity 32. As the settling of particulate matter and other debris proceeds, the amount of particulate matter and other debris suspended in the fluid changes. Accordingly, different locations within the fluid body, or phases, have different concentrations of particulate matter and other debris. The heavier debris settles to the floor of cavity 32 and may eventually settle in rat hole 34.

The relative size of the particulate matter and other debris changes across the different phases of the fluid body. The smallest particulate matter and other debris remains close to the surface in Phase III, as shown in FIG. 3A. As the particulate matter and other debris coalesces or clumps together, the composite matter begins to settle through the phases and may eventually fill the rat hole 34 and form a solid layer of sludge on the floor of cavity 32. Eventually, the depth of the sludge layer and size of the composite matter is such that the pump inlets 24 become clogged, causing production delays and added expense.

Referring to FIG. 3B, the blunt arms 14 are rotated in the cavity 32 about the longitudinal axis of pump string 20 by rotating the pump string 20 at the surface or by other suitable means. In one embodiment, the pump string is rotated at the surface by a tubing rotator, at approximately one rotation per day.

Rotating the blunt arms 14 agitates the fluid collected within the cavity 32. In the absence of agitation the particulate matter and other debris may coalesce or clump together forming larger composite matter that would eventually clog the pump inlets 24. With rotation of the blunt arms 14, however, solids remain suspended in the fluid and are removed with the fluid. In addition, the distribution of the remaining particulate matter is pushed away from the pump inlets 24, towards the sidewalls of cavity 32.

As illustrated in FIG. 3B, rotation of the blunt arms 14 causes the levels or phases decrease in area. Furthermore, rotation causes the shape of the phases to become more sharply sloping from the sidewalls of cavity 32 towards the floor of cavity 32. The change in shape of the phases prevents particulate matter from clumping in the liquid in the near vicinity of the pump inlets 24. Thus, rotation of the blunt arms 14 decreases the concentration of large particulate matter and other debris surrounding the pump inlets 24, and thereby greatly reduces clogging of the pump inlets 24, and the increased costs associated therewith.

Although the present invention has been described in detail, it should be understood that various changes, alterations, substitutions, and modifications may be made to the teachings herein without departing from the spirit and scope of the present invention, which is solely defined by the appended claims.

What is claimed is:

1. A method, comprising:

lowering a downhole device having a pump inlet and a fluid agitator via a well bore into fluid of a substrate cavity formed in a subterranean zone, the fluid agitator comprises a plurality of arms that are outwardly extendable, the fluid agitator operable to be longitudinally adjusted in the substrate cavity after the plurality of arms are extended;

agitating the fluid using the fluid agitator; and wherein agitating the fluid comprises rotating the arms at a rate of no more than ten revolutions per day.

2. A method of claim 1, and further comprising removing the fluid from the subsurface cavity using the pump inlet.

3. A method of claim 1, and further comprising removing the fluid from the subsurface cavity through the pump inlet while the fluid is agitated by the fluid agitator.

4. A method of claim 1, wherein agitating the fluid comprises rotating the arms at a rate of no more than five revolutions per day.

5. A method of claim 1, wherein agitating the fluid comprises rotating the arms at a rate of no more than one revolutions per day.

6. The method of claim 1, wherein the downhole device is positioned in the subsurface cavity via a well bore having a first diameter, and the downhole device is changeable to a diameter that is greater than the first diameter.

7. A method comprising:

lowering a downhole device having a pump inlet and a fluid agitator via a well bore into fluid of a subsurface cavity formed in a subterranean zone, the fluid agitator comprises a plurality of arms that are outwardly extendable, the fluid agitator operable to be longitudinally adjusted in the subsurface cavity after the plurality of arms are extended;

agitating the fluid using the fluid agitator; and wherein the fluid agitator comprises a plurality of blunt arms that are outwardly extendable.

8. A method, comprising:

lowering an inlet of a pump via a well bore into a cavity formed underground, the cavity including fluid and a plurality of particles in the fluid;

agitating the fluid using a plurality of arms, the inlet of the pump operable to be longitudinally adjusted in the subsurface cavity while agitating the fluid;

removing the fluid; and wherein agitating the fluid comprises rotating the arms at a rate of no more than ten revolutions per day.

9. The method of claim 8, wherein the inlet of the pump is coupled to the plurality of arms that are operable to extend radially within the cavity, and wherein agitating the fluid comprises extending the arms and rotating the arms about a longitudinal axis of the pump.

10. The method of claim 9, wherein the extended arms exceed a diameter of the well bore.

11. A method of claim 9, wherein agitating the fluid comprises rotating the arms at a rate of no more than five revolutions per day.

12. A method of claim 9, wherein agitating the fluid comprises rotating the arms at a rate of no more than one revolutions per day.

13. A method of claim 8, wherein the act of removing the fluid is performed while agitating the fluid.

14. A method of claim 8, wherein the pump is a suction-rod pump.

15. A method of claim 8, wherein the pump is a downhole pump.

16. A method comprising:

lowering an inlet of a pump via a well bore into a cavity formed underground, the cavity including fluid and a plurality of particles in the fluid;

agitating the fluid using a plurality of arms, the inlet of the pump operable to be longitudinally adjusted in the subsurface cavity while agitating the fluid;

removing the fluid; and wherein the inlet of the pump is coupled to a plurality of blunt arms that are operable to extend radially within the cavity, and wherein agitating the fluid comprises extending the blunt arms and rotating the blunt arms and rotating the blunt arms about a longitudinal axis of the pump.

17. A method for removing particulate laden fluid from a subterranean zone, comprising:

lowering an inlet of a pump through a well bore into a cavity formed in a subterranean zone, the cavity having a transverse dimension greater than a transverse dimension of the well bore;

radially extending within the cavity a plurality of arms coupled to the pump inlet, the pump inlet operable to be longitudinally adjusted in the cavity after extending the plurality of arms;

collecting particulate laden fluid in the cavity;

rotating the arms about a longitudinal axis of the pump;

removing the particulate laden fluid with the pump; and wherein the arms are rotated at a rate of no more than ten revolutions per day.

18. The method of claim 17, wherein the extended arms exceed a diameter of the well bore.

19. A method comprising:

lowering an inlet of a pump through a well bore into a cavity formed in a subterranean zone, the cavity having a transverse dimension greater than a transverse dimension of the well bore;

radially extending within the cavity a plurality of arms coupled to the pump inlet, the pump inlet operable to be longitudinally adjusted in the cavity after extending the plurality of arms;

collecting particulate laden fluid in the cavity;

rotating the arms about the longitudinal axis of the pump;

removing the particulate laden fluid with the pump; and wherein each of the arms are blunt.

* * * * *